United States Patent [19]

Snyder et al.

[11] 4,257,527

[45] Mar. 24, 1981

[54] PLASTIC DRUM

[75] Inventors: Larry L. Snyder; LaVelle H. Hansen, both of Lincoln, Nebr.

[73] Assignee: Snyder Industries, Inc., Lincoln, Nebr.

[21] Appl. No.: 711,562

[22] Filed: Aug. 4, 1976

[51] Int. Cl.[3] ..... B65D 7/42; B65D 7/02

[52] U.S. Cl. ..... 220/72; 220/74; 220/5 R

[58] Field of Search ..... 220/72, 5 R, 74, 66, 220/288, DIG. 1, 254, 306, 307, 315; 294/90; 215/201, 209, 211, 356, 357

[56] References Cited

U.S. PATENT DOCUMENTS

| | | | |
|---|---|---|---|
| 2,254,005 | 8/1941 | Dodson | 220/DIG. 1 |
| 2,787,397 | 4/1957 | Radford | 220/72 X |
| 3,279,640 | 10/1966 | Dodson | 220/5 R |
| 3,310,336 | 3/1967 | Chenault | 294/90 |
| 3,338,616 | 8/1967 | Ericson | 294/90 X |
| 3,889,839 | 6/1975 | Simon et al. | 220/72 |
| 3,915,330 | 10/1975 | Hammes et al. | 220/74 |
| 3,985,257 | 10/1976 | Shaffer et al. | 220/72 X |

*Primary Examiner*—Steven M. Pollard
*Attorney, Agent, or Firm*—Schuyler, Banner, Birch, McKie & Beckett

[57] ABSTRACT

A drum capable of being molded in 55 gallon size from high density, cross-linked polyethylene. The drum body or shell has substantially cylindrical walls closed at both ends, respectively, by top and bottom end pieces or heads integral with the sidewalls. The drum includes an integrally molded hollow arcuate chime located at the intersection of the top end piece or head and the cylindrical sidewall and extending circumferentially around the drum. A plurality of rolling hoops located between the top and bottom end pieces extend circumferentially around the drum and protrude sufficiently outward from the drum walls to permit sufficient engagement by the forks of a forklift to support a fully loaded drum thereon. The drum may be reinforced by a plurality of inwardly protruding vertical ribs which run continuously substantially from the top to the bottom of the drum. The top end piece or head includes at least one bunghole integrally formed therewith. The bunghole is threaded to receive a bung and, preferably, is elevated from the plane of the top end piece.

16 Claims, 7 Drawing Figures

PLASTIC DRUM

BACKGROUND OF THE INVENTION

1. Field of the Invention

The present invention relates generally to containers and, more particularly, to 55 gallon drums molded of cross-linked polyethylene which drums are suitable for shipment in interstate commerce on common carrier equipment.

2. Description of the Prior Art

Numerous attempts have been made to utilize synthetic polymeric materials in shipping containers for liquids and other substances. Polymeric materials, hereinafter called plastics, have certain potential advantages as shipping containers. Plastics are relatively resistant to many chemicals, such as acids and alkalis, which easily corrode most metals. In addition, because plastics are inherently lighter than metals, plastic drums have a lower shipping weight than conventional steel drums. Unfortunately, however, plastics by and large do not possess the necessary structural strength to withstand the rigors of use in common commercial carriers.

Before any plastic drum can be sold for common carrier usage, it must meet the rigorous federal regulations set forth in 49 CFR § 178.19 governing polyethylene plastic containers. These regulations provide, inter alia, that plastic drums be able to withstand various compression loads based on the capacity of the drum. At the present time, these regulations only cover drums ranging in capacity from 2½ gallons to 30 gallons, although a standard for 55 gallon plastic drums has recently been proposed. Prior to our invention no drum has yet been manufactured which passes all the proposed federal regulations for 55 gallon plastic drums and, in addition, is capable of being handled using all conventional drum handling equipment.

Attempts have been made to prepare plastic drums ranging up to 55 gallons in capacity. Such attempts have largely been unsuccessful because the drums either lacked the necessary compression strength, load temperature impact strength, or have been so difficult to handle using the ordinary drum handling equipment available to common carriers as to be commercially unacceptable.

U.S. Pat. Nos. 3,927,790 to Chase et al and 3,940,011 to Dubois et al disclose attempts to manufacture various 55 gallon plastic drums capable of being handled by conventional drum handling equipment. These patents depict generally keg-shaped drums having a plurality of flat sides or slots adapted to be engaged by a conventional forklift. Similarly, U.S. Pat. No. 3,889,939 to Simon et al discloses a plastic drum having slots on opposite sides of the drum engageable by a forklift and a ring or a slot on the top of the drum for handling by a standard handtruck.

All such keg-shaped or slotted drums, however, are not easily handled with conventional drum handling equipment because the handling equipment must be carefully positioned with respect to the drum so that the equipment will engage the flat sides, slots or other engaging paraphernalia. In practice, a worker using a forklift or a standard handcart will often be required to manually rotate the drum into the exact position necessary for handling before using the lift or handcart. Because a 55 gallon drum filled with liquid is extremely heavy and difficult to handle, such drums have not received great commercial acceptance because of the extra labor and time involved in orienting them to receive the drum handling equipment.

Furthermore, although attempts have been made to design plastic drums capable of being handled by a forklift and a standard handtruck, to the best of our knowledge, no such plastic drum has ever been capable of also being handled by use of the device known in the cargo industry as the "parrot beak". "Parrot beak" equipment is drum handling equipment which lifts a conventional steel drum using a jaw-like device which attaches to the top chime or bead of the drum, the chime or bead thereby bearing virtually all the weight of the drum. Typical of "parrot beak" drum handling equipment is the LIFT-O-MATIC Model PTA-720 of Marvel Industries, Inc., Evanston, Illinois.

Various prior art plastic drums, such as that shown in U.S. Pat. No. 3,889,939 disclose polyethylene drums made by a process called "blow molding". Blow molded drums are inherently uneven in thickness and, being thicker in the ends and top and thinner at the rolling hoops, often fail in the compression testing mandated by the applicable government regulations. Moreover, when fully loaded blow molded drums are stacked on top of each other, the lower drums tend to cave in.

Attempts have been made in the past to prepare drums using the rotational molding process. Such drums inherently have the same thickness throughout and, when properly designed, do not fail in compression. One such drum currently being marketed comprises a multilayer laminate having a thin skin of cross-linked, high density polyethylene, a foam core of a second plastic and an inner skin of a different material. However, this multilayer drum is not designed for easy handling using forklift or handtruck equipment and cannot be handled by "parrot beak" equipment.

Drums have been prepared using a single thickness of rotationally molded, cross-linked, high density polyethylene. Although these drums were provided with rolling hoops on the sides, the hoops could not support the weight of a fully loaded drum when engaged by the forks of a forklift truck. In addition, while various designs for the drum top or head were used or experimented with (one experimental model included slots in the top which could accommodate flanges on drum handling handtrucks), these drums could not be handled by "parrot beak" equipment.

SUMMARY OF THE INVENTION

It is an object of the present invention to overcome the above-noted disadvantages of the prior art by providing a plastic drum of high density, cross-linked polyethylene which can be handled by conventional forklift, handtruck and "parrot beak" equipment.

It is a further object of the present invention to provide a plastic drum which can be readily handled by conventional drum handling equipment without prior positioning of the drum whether the equipment is a forklift, a handtruck or a "parrot beak" equipment.

It is an additional object of the present invention to provide a plastic drum having an improved bunghole which is not susceptible to leakage caused by vapor pressure contained inside the drum.

It is another object of the present invention to provide a polyethylene plastic drum having an improved bunghole with shart and precise threads molded therein.

The present invention accomplishes the foregoing and other objects by providing a plastic drum comprising a substantially cylindrical body having a continuous substantially cylindrical sidewall. The cylinder is closed at its top and bottom ends, respectively, by top and bottom end pieces. A hollow substantially arcuate annular chime is integrally formed at the juncture of the continuous sidewall and the top end piece to provide an arcuate bearing surface for engagement by a "parrot beak" device.

The hollow annular chime is circumferentially located at the juncture of the sidewall and the top end piece and comprises an arcuate outer wall having a convex shape. The chime is integrally molded with and attached to the vertical wall of the drum by a short outwardly extending flared section of the wall. An annular downwardly projecting section connects the arcuate outer wall of the chime to the surface of the top end piece. The chime is so formed that it will not prematurely trigger the "parrot beak" device. Although hollow, the plastic, integrally molded chime can support the entire weight of a fully loaded drum in the jaws of a "parrot beak" device. Because the top chime circumferentially surrounds the drum, the chime can be readily seized by the "parrot beak" from any position.

The drum also includes at least one and preferably two additional rolling hoops molded integrally into the wall of the drum. The rolling hoops are extended outwardly from the vertical wall of the drum a sufficient distance so that they can be engaged by the forks of a forklift and lifted upwardly even when the drum is fully loaded. The rolling hoops need not be continuous about the circumference of the drum and may be interrupted by a plurality of continuous vertical ribs. Nevertheless, the hoops should be sufficiently circumferential to enable ready lifting and engagement of the drum from any position without prior positioning of the drum. The continuous vertical ribs which interrupt the rolling hoops are also integrally formed with the vertical wall of the drum but protrude inwardly therefrom. The ribs reinforce the drum and add considerable compressive strength to the sidewalls of the drum.

The drum of the present invention also includes at least one bunghole on the top end piece. Preferably, the bunghole is raised above the top end piece by means of a connecting flange which permits a limited degree of expansion between the bunghole and the top end piece. This limited expansion prevents leakage by accommodating vapor pressure built up inside the drum when a fully loaded drum is stored in the sun. The bunghole may be provided with integrally molded threads for receiving a bung. NPS threads are used in practice.

Alternatively, the bunghole may be provided with a threaded polygonal recess for receiving a polygonal insert. The polygonal insert is threaded and is adapted to be screwed into the bunghole and locked in place in the recess. The insert also contains an opening for receiving a bung having very sharp and precise threads therein since the insert is formed by a process known as injection molding.

DESCRIPTION OF THE PREFERRED EMBODIMENT

Figure 1:
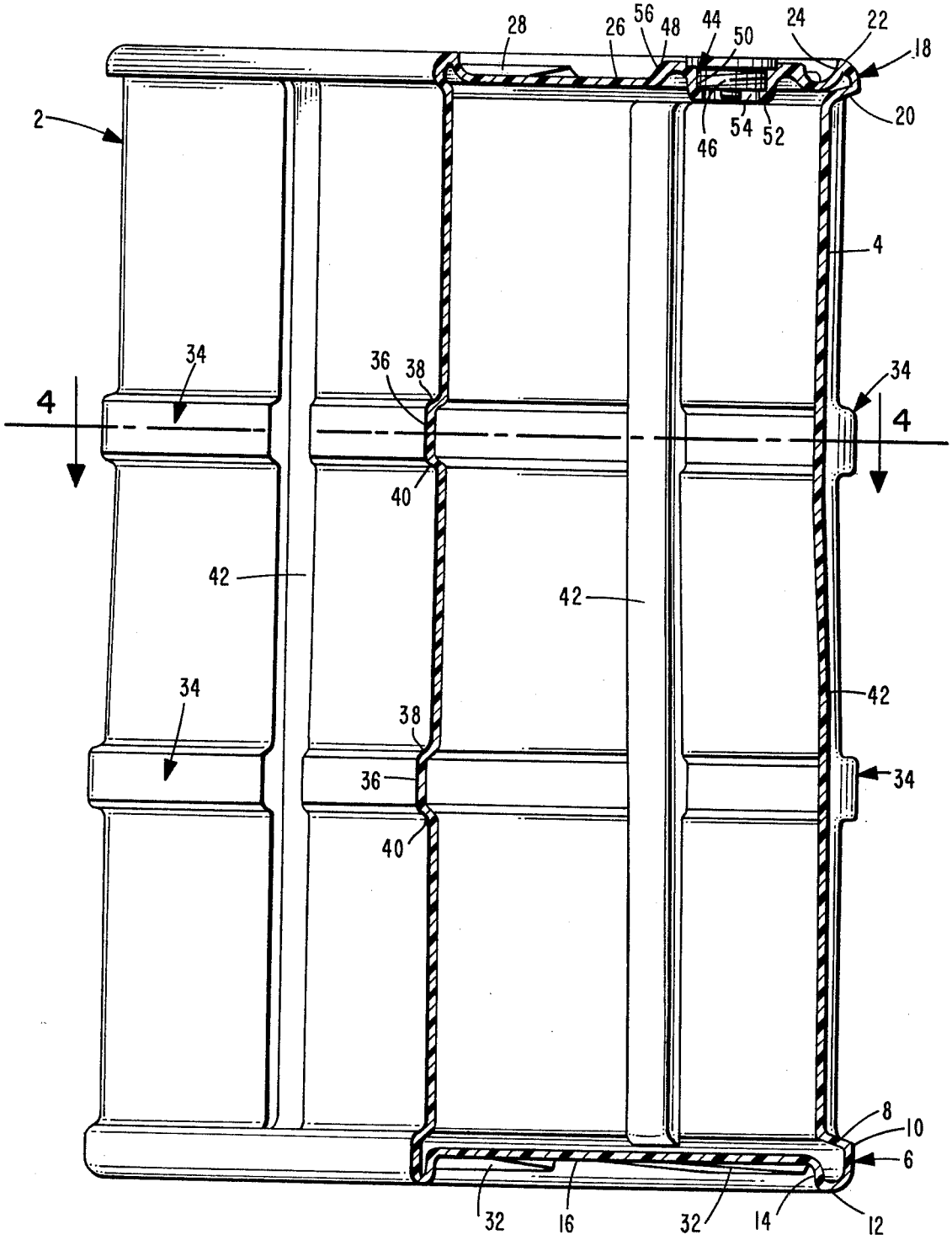
FIG. 1 is a partial cross-sectional side elevation view of a drum according to the present invention.

Referring now to FIGS. 1–4, a drum 2 according to the present invention, preferably a 55 gallon drum, comprises substantially a cylinder having a continuous substantially vertical wall 4. As depicted in FIG. 1, the diameter of the drum 2 at its lower end may be nominally greater than the diameter at its top end to provide additional capacity without increasing the height of the drum. The drum 2 is necessarily rotationally molded from a high density, cross-linked polyethylene plastic as will be described in more detail hereafter. The height and width of the drum may vary, however, we have found a drum 35–37 inches high and 23–24 inches wide will hold 55 gallons and is not so high as to preclude the use of conventional automatic filling equipment.

A U-shaped annular lower support chime 6 is integrally formed with the vertical wall 4 and is connected to the lower end of wall 4. The support chime 6 comprises an upper wall 8, an outer wall 10 spaced outside the plane of the wall 4, a horizontal bottom wall 12 and an inner wall 14. The bottom wall 12 of the support chime 6 is adapted to rest on the ground to thereby support the weight of the drum 2 and its contents. The bottom of the drum 2 is closed by a circular bottom end piece 16, integrally formed with the continuous wall 4 and the support chime 6 and connected to the inner wall 14 of the support chime 6 as shown in FIG. 1.

Similarly, a hollow annular upper chime 18 is also molded integrally with vertical wall 4 and is connected to the upper end of the wall 4 by horizontal wall 20. The chime 18 is hollow and comprises a convexly curved outer wall 22 spaced at least $\frac{1}{4}$ of an inch and preferably $\frac{1}{2}$ of an inch outwardly from the vertical wall 4 by wall 20 and a concavely curved inner wall 24. The uppermost portion of wall 24 is essentially vertical. The chime 18 forms an arcuate bearing surface for engagement by a "parrot beak" device used on conventional drum handling equipment as will be explained more fully hereafter. The top of the drum 2 is closed by a circular top end piece or head 26 molded integrally will continuous wall 4 and chime 18 and connected to inner wall 24 of chime 18 as shown in FIG. 1. It has been found that although wall 20 and the lower portion of outer wall 22 are straight segments at substantially right angles to each other, the rotational molding process used to mold the drum imparts a slight curve to the junctures. This is true of virtually all junctures of the drum. Because of the rotational molding process all of the previously described components of the drum, i.e., the vertical wall 4, the support chime 6, etc., have approximately the same thickness.

Figure 2:
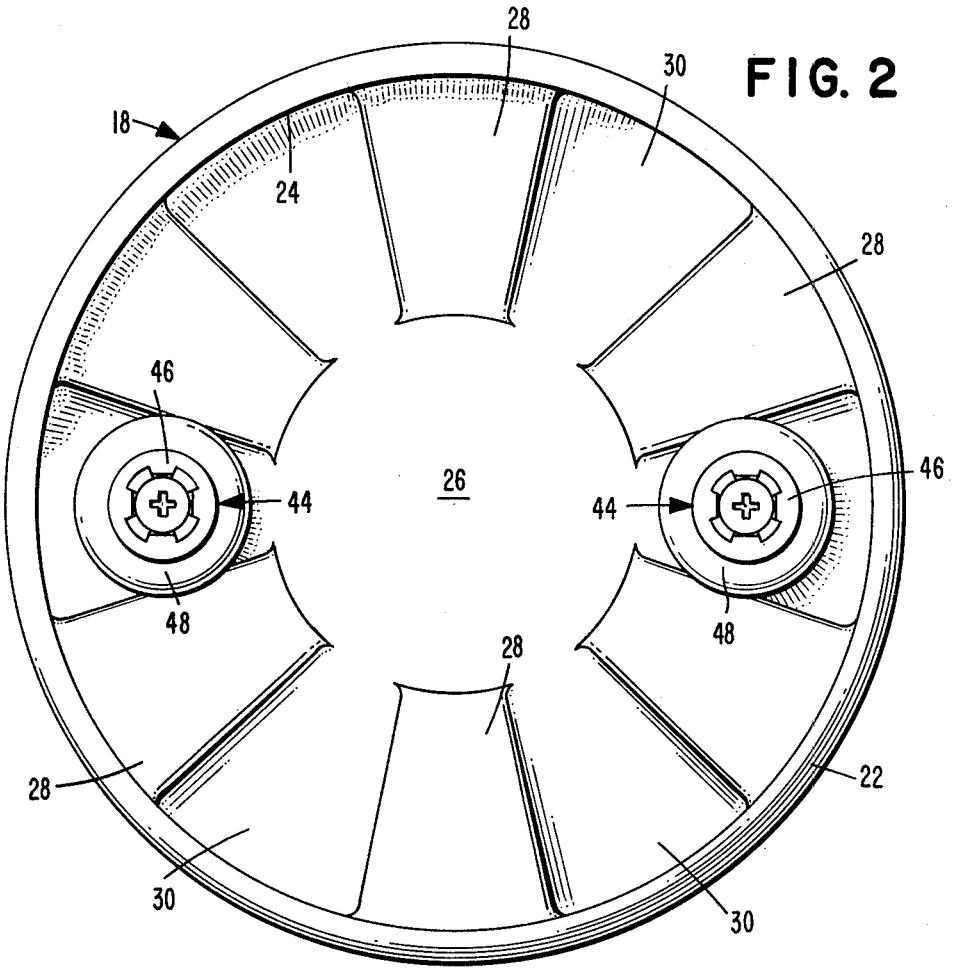
FIG. 2 is a top view of a drum according to the present invention.
Figure 3:
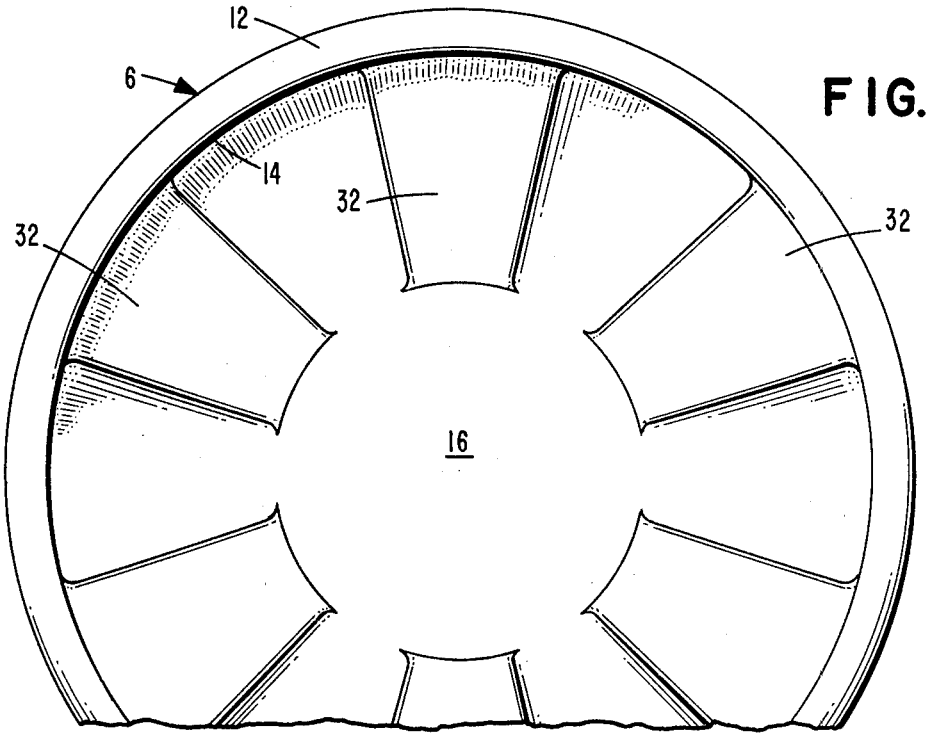
FIG. 3 is a bottom view of a drum according to the present invention.
Figure 4:
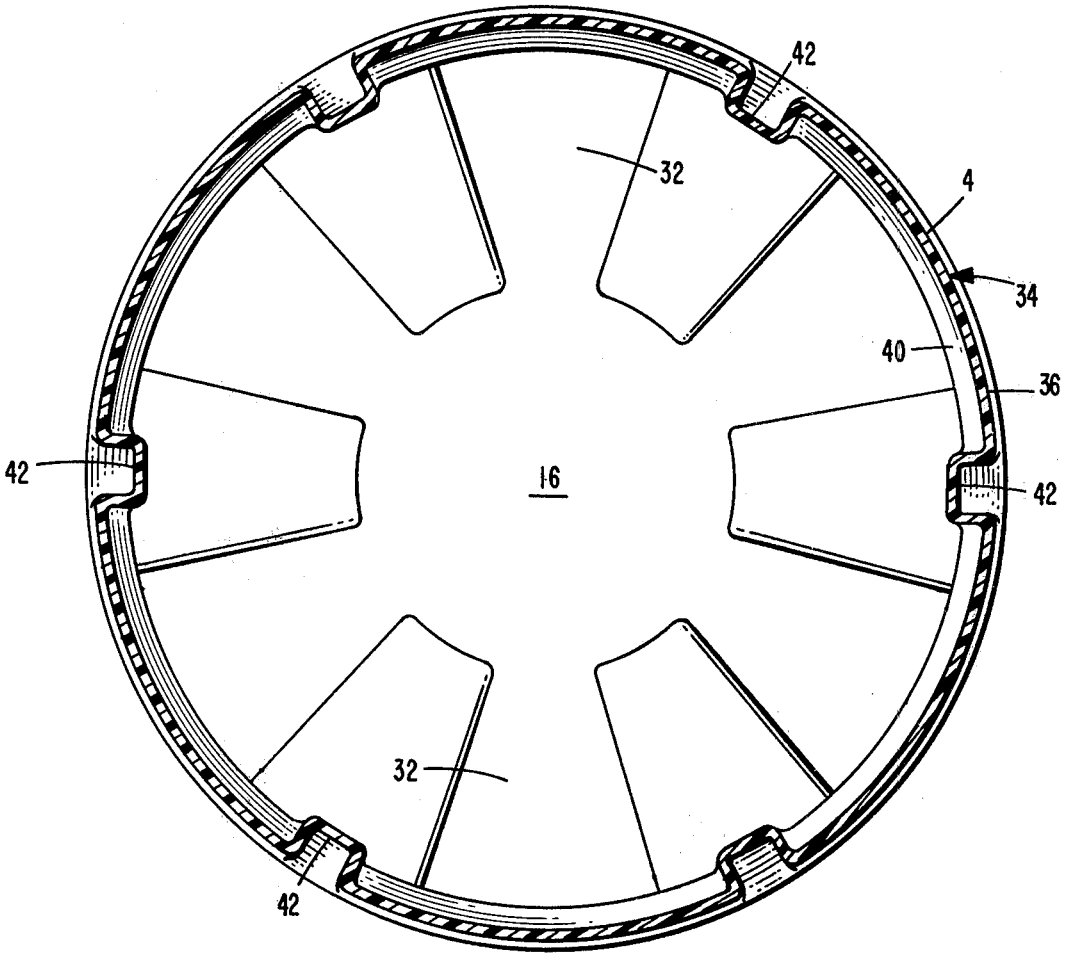
FIG. 4 is a cross-sectional view taken along line 4—4 of FIG. 1.

The circular top end piece or head 26, shown more particularly in FIG. 2, serves as a lid for the drum 2. The top end piece 26 has a plurality of raised portions or lands 28 which are circumferentially spaced about the periphery of the top end piece 26. These lands 28 extend inwardly from the outer edge of the top end piece 26 and terminate at a constant radius from the center of the top end piece 26. The lands 28 are separated by flat areas 30 which are, in effect, merely at the same level as the center of the top end piece 26. Similarly, the bottom end piece 16, shown in FIG. 3, has a plurality of lands 32 circumferentially spaced about the periphery of the bottom end piece 16 in a manner similar to the lands 28 in the top end piece 26.

The drum 2 is provided with horizontal rolling hoops 34 which are integrally formed in continuous wall 4 of the drum 2 at spaced locations thereof. Each rolling hoop 34 is preferably 2 inches wide and comprises a section 36 spaced outwardly from the plane of the wall 4 by substantially horizontal top and bottom surfaces 38 and 40, respectively. The distance which the hoops 34 are spaced outwardly from the wall 4 must be such that the forks of a forklift truck can engage the bottom surface 40 of at least the upper hoop 34 and support the weight of a 55 gallon drum loaded with water. This distance may, of course, be varied; however, for a plastic drum made of a high density, cross-linked polyethylene with a capacity of 55 gallons, it has been found that hoops 34 spaced outwardly from the wall a distance of ½ inch will be sufficient to support the drum 2 under ordinary conditions of use.

The hoops 34 extend around the circumference of the drum 2 but need not be continuous since they may be broken by a plurality of continuous, inwardly projecting vertical ribs 42 integrally formed in wall 4 at circumferentially spaced locations. When used, ribs 42 extend along substantially the entire length of wall 4 between top closure 26 and bottom closure 16. It is preferred to provide approximately six ribs 42 having a width of 1½ inches because the ribs strengthen the drum in compression and prevent bulging of the drum walls when fully loaded drums are stacked upon each other. Needless to say, ribs 42 may not be needed when the drum 2 is manufactured in smaller sizes or when the thickness of the material forming the drum 2 is such that no bulging of the drum would occur under normal conditions of use. Use of the ribs 42, however, decreases the amount of material and the wall thickness needed in the drum 2.

As best seen in FIGS. 1 and 2, top end piece 26 is provided with at least one bunghole 44 to serve as a means of filling and/or emptying the drum. Preferably two bungholes are provided. The bungholes 44 are integrally molded in top end piece 26 and are preferably placed 180° apart in the flat areas 30 in the top end piece 26. The bungholes are ultimately designed to accommodate a conventional bung. In one embodiment of this invention, bungholes 44 comprise a top surface 48, a threaded vertical wall 50, and a bottom surface 52 with an opening 54 therein. The threads in the vertical wall 50 of the bunghole 44 are integrally molded therein and are preferably the standard NPS threads used in conventional drums.

Preferably bungholes 44 are raised above the surface of the top end piece 26 by means of a connecting flange 56 so that the opening 54 in the bottom surface 52 of the bungholes 44 is approximately coplanar with top end piece 26. The connecting flange 56 should be short enough so that a bung 46 contained in the bunghole 44 does not protrude above top chime 8. The raising of the bunghole 44 above the top end piece 26 is advantageous since substantially all of the material contained in the drum 2 can be drained therefrom when the drum is tipped upside down because the opening 54 of the bunghole 44 is now approximately at the same level as the end piece 26.

Connecting flange 56 is particularly important because it provides for absorption of a limited, but necessary, degree of expansion between the bunghole 44 and the top closure 26. When a liquid material stored in plastic drums is set out in the sun, a vapor pressure will be built up inside the drum due to the evaporation of the liquid. This vapor pressure tends to cause the top and bottom closures of the drum to bow outwardly along the unsupported portions of the closures. When the bunghole is indented or molded flat with the top end piece, the bunghole assumes the bowed shape of the top end piece under pressure and depending upon the extent of the bow can cause leakage around the bung in the bunghole. However, when according to the present invention, the bunghole is raised, there is no leakage around the bunghole 44 since the bunghole 44 can expand to a limited degree relative to the top end piece 26 to accommodate the vapor pressure built up inside the drum.

We have found that the threads formed in the rotational molding process, although usable, are somewhat pitted and rough and generally not as precise as desired. In a preferred embodiment of this invention, bungholes 44 are integrally molded into the top end piece 26 in such manner as to permit the use of an expendable and replaceable bunghole insert.

Figure 6:
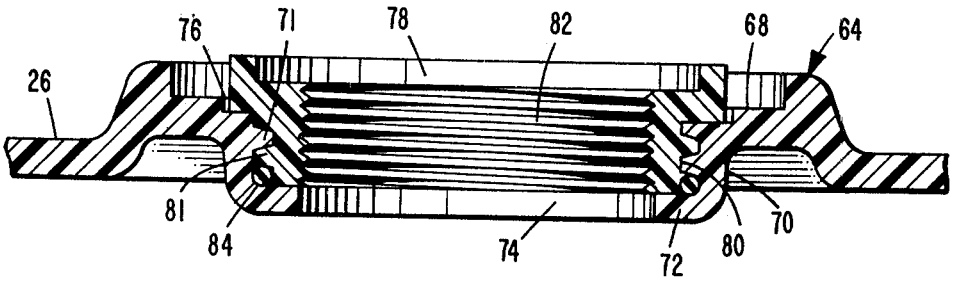
FIG. 6 is a cross-sectional side elevation view taken along line 6-6 of FIG. 5.
Figure 5:
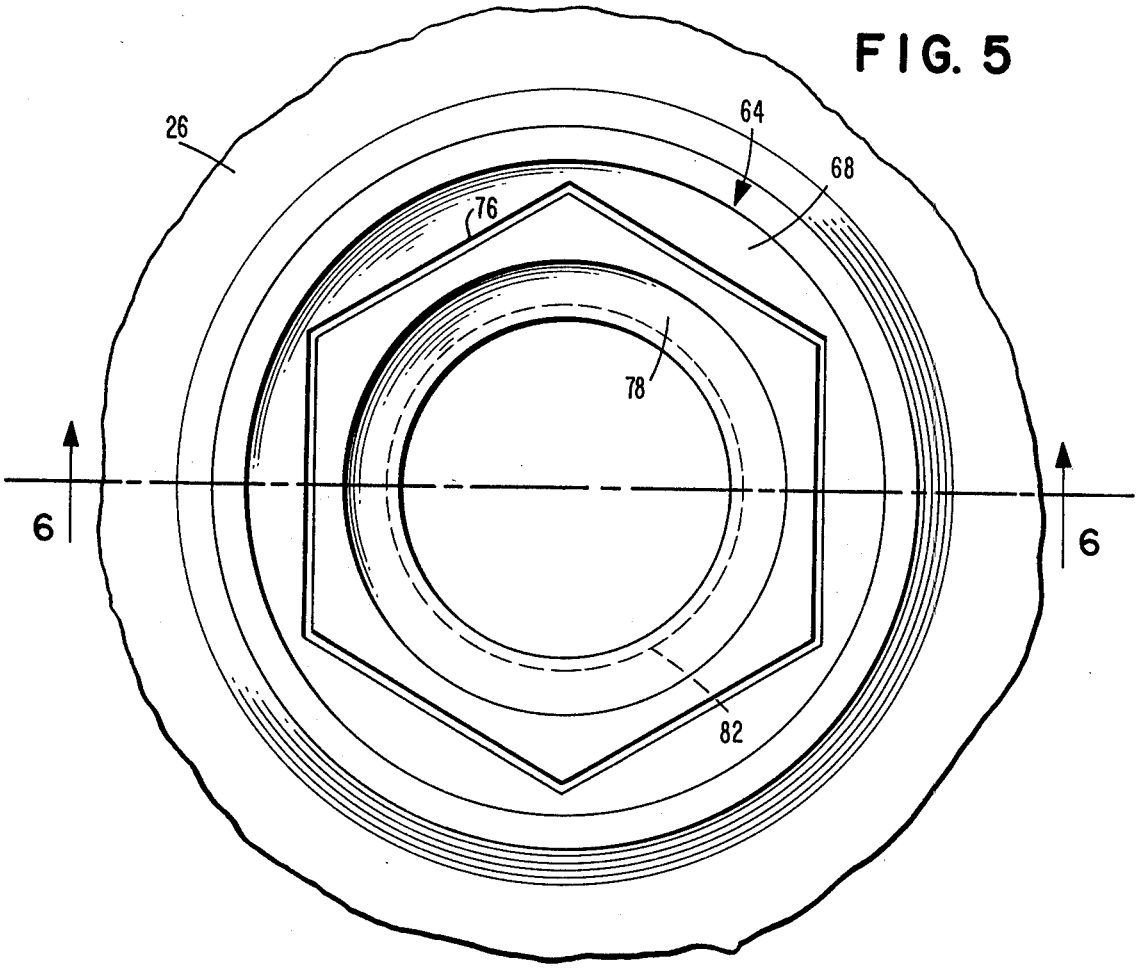
FIG. 5 is a top view of an alternative embodiment of the bunghole for the drum of the present invention.

FIGS. 5 and 6 depict a preferred embodiment of this invention wherein a threaded bunghole 64 having a top surface 68, a threaded sidewall 70, and a bottom surface 72 with an opening 74 therein is integrally molded into the top end piece 26 in a raised position in the same manner as the bungholes 44 shown in FIGS. 1 and 2. However, the top surface 68 of the bunghole 64 is provided with a polygonal, preferably hexagonal, shaped recess 76.

In addition, the threads 71 provided on the sidewall 70 of the bunghole 64 are threads having a considerably large pitch than the standard NPS threads. Threads with a large pitch, such as the preferred Acme or Modified Acme threads, may be more precisely formed in the rotational molding process used to mold the drum.

A polygonal insert 78 which is shaped to match the polygonal recess 76 in the top surface 68 of the bunghole 64 may be formed of a plastic such as nylon which is amenable to conventional injection molding processes. The polygonal insert 78 has an outer surface 80 provided with Acme-type threads 81 designed to mate with threads 71 of bunghole 64. In practice, polygonal insert 78 is screwed into the bunghole 64 until the insert 78 locks itself into the corresponding polygonal recess 76 provided in the top surface of bunghole 64.

Bunghole insert 78 also has a threaded opening 82 adapted to receive a standard bung 46 conventionally used to close bungholes (see FIGS. 1 and 2). Because insert 78 may be injection molded, threaded opening 82 carries sharp, precise and durable standard NPS threads. An O-ring 84 may be placed between the polygonal insert 78 and the bunghole 64 to assist in sealing the drum.

Preferably a hexagon shape is used for polygonal recess 76 and insert 78 because the hexagon shape provides sides which are short enough to permit screwing insert 78 into bunghole 64 but long enough to provide locking engagement when insert 78 is seated in recess 76. If a polygon having too many sides is chosen for the polygonal recess and insert, then the shape of the recess begins to approximate a circle and will not firmly lock insert 78 when it is seated therein. For example, an octagon-shaped polygonal insert does not work as well as a hexagon-shaped insert.

Figure 7:
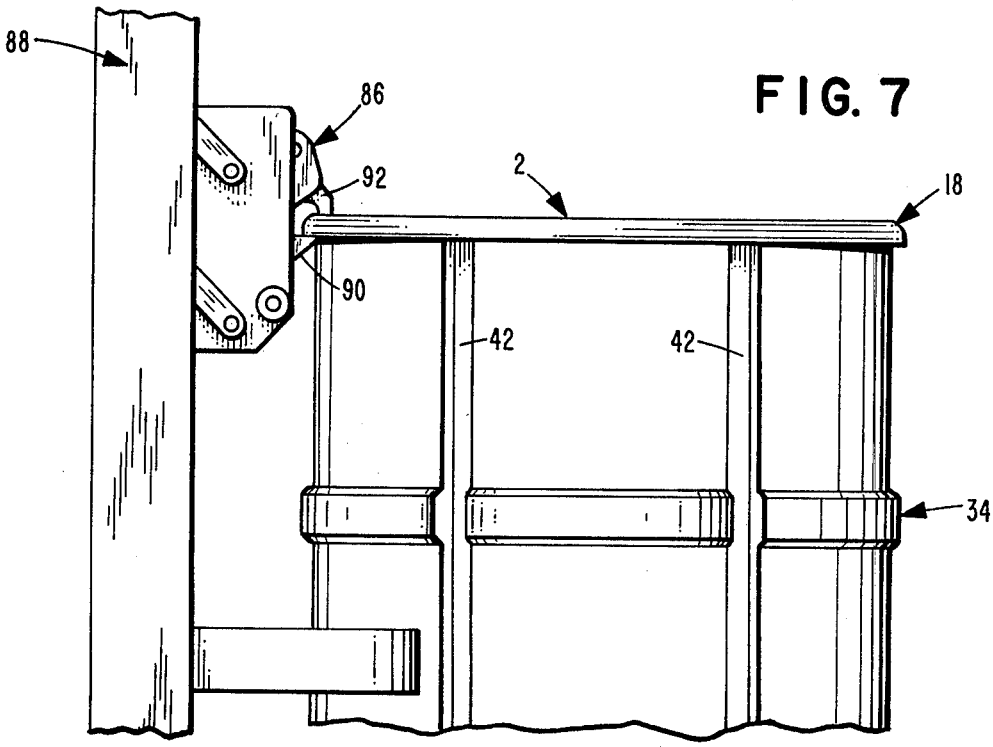
FIG. 7 is a side elevational view of a drum according to the instant invention engaged by a "parrot beak" device.

As mentioned previously, the chime 18 of the drum 2 has been specially designed so that it can be handled by what is known as a "parrot beak". As seen in FIG. 7, a "parrot beak" 86 is utilized on a piece of conventional drum handling equipment 88 and comprises a lower flange 90 and a pivotally mounted top hook 92. The lower flange 90 is adapted to engage underneath the shoulder of upper chime 18 formed by the wall 20 connecting chime 18 to wall 4. Top hook 92 fits over arcuate outer surface 22 of chime 18 and engages inner wall 24 of chime 18. The "parrot beak" 86 is usually held open as the drum handling equipment 88 approaches a drum and its closing is automatically triggered by the presence of the chime.

We have discovered that the convex arcuate shape of the outer wall 22 of the chime 18 is necessary to prevent premature triggering of the "parrot beak". We have also discovered that it is necessary to provide a sufficient distance between the top of the chime and the surface of top end piece 26 to permit engagement by the "parrot beak". Preferably the distance is 9/16 of an inch and at least ⅜ of an inch. It was highly surprising that a hollow chime 18 formed of a cross-linked polyethylene could be gripped and lifted by a "parrot beak" and still support the weight of the drum without collapsing or otherwise damaging upper chime 18.

Drum 2 and its component parts, i.e., wall 4, top and bottom end pieces 26 and 16, the chime, etc., are all integrally molded in a single operation from a high density, cross-linked polyethylene. We have evaluated numerous thermoplastic practicals and have discovered that only high density, cross-linked polyethylene yields a drum capable of meeting the proposed government standards for 55 gallon drums. Typical polyethylenes which may be used are Marlex CL-50 and Marlex CL-100 cross-linked, high density polyethylenes sold by Phillip Petroleum Company.

Typically, the drums may be molded as follows: (a) the molds for the drum are first sprayed with a release agent and wiped dry; preferably the release agent is a fluorocarbon such as FREKOTE 33 manufactured by Frekote, Inc., of Indianapolis, Indiana; (b) approximately 25 pounds of high density, cross-linked polyethylene powder ground to 35 mesh is charged into the mold. The actual amount of material charged into the mold may be varied depending upon the thickness desired in the finished drum. In practice 25 pounds of powder will yield a 55 gallon drum having walls with a thickness of about 3/16 of an inch; (c) after the mold has been charged, it is placed inside the oven of a conventional rotational molding machine, such as the McNeil 1000-64"Autocast" machine. The oven is preheated to a temperature of about 580° F. The mold is then rotated inside the oven for 17 minutes. The damper of the oven is preferably opened for the first five minutes of the seventeen minute cycle to allow a rapid warmup of the mold, but is closed for the remainder of the cycle to prevent overheating of the mold; (d) at the conclusion of the oven cycle, the mold is cooled for 15 minutes as follows: five minutes of cooling under ambient air, five minutes of cooling under a water spray and five minutes of cooling under an air blast.

We have evaluated the 55 gallon drums of this invention and determined that they pass all the physical tests in Federal Regulation 49 CFR § 178.19–7. In this test, the proposed compression test for 55 gallon drums is 2,400 pounds.

Although the present invention has been illustrated in terms of a preferred embodiment, it will be obvious to one of ordinary skill that numerous modifications may be made without departing from the true spirit and scope of the invention which is to be limited only by the appended claims.

We claim:

1. A drum molded of cross-linked, high density polyethylene, said drum comprising:

(a) a body having a continuous substantially cylindrical wall of cross-linked polyethylene closed at its top and bottom ends, respectively, by top and bottom end pieces of cross-linked polyethylene molded and formed integrally with said continuous wall;

(b) an arcuate, hollow load bearing chime of cross-linked polyethylene integrally molded and formed with and connecting the top of said wall with said top end piece, said chime extending above the surface of said top end piece, and comprising a substantially arcuate outer wall, integral with and connected to the top of said continuous wall by a short outwardly flared section of said continuous wall, and an inner wall connected between said outer wall and said top surface, said chime being capable of being lifted and supported by parrot-beak type drum handling equipment;

(c) at least one rolling hoop formed integrally with said continuous wall and located in the body of said drum between said chime and said bottom end piece, said hoop extending circumferentially around said continuous wall and capable of being engaged by the forks of a forklift regardless of the orientation of said cylinder relative to the forklift, said hoop further extending outwardly from said continuous wall a sufficient distance to support a fully loaded drum when said hoop is engaged by the forks of the forklift; and (d) a plurality of vertical ribs formed integrally with said continuous wall at spaced circumferential positions and extending inwardly therefrom.

2. The drum of claim 1 wherein said chime is an annular chime extending around the circumferene of said cylinder.

3. The drum of claim 1 wherein said outer wall is convexly curved and the bottom portion of said outer wall is substantially vertical.

4. The drum of claim 1 wherein two rolling hoops are integrally molded in said continuous wall at vertically spaced locations.

5. The drum of claim 1 wherein said ribs are continuous from the top to the bottom of said continuous wall thereby interrupting said hoop at said spaced positions.

6. The drum of claim 2 further comprising a threaded bunghole formed of and molded integrally with said top end piece, said bunghole having an opening therein and being raised above the surface of said top end piece whereby said opening is substantially flush with the surface of said top end piece.

7. The drum of claim 6 wherein said bunghole is integrally connected to said top end piece by a flange capable of absorbing expansion between said bunghole and said top surface when the pressure of the contents of said drum is increased.

8. In a plastic drum having walls and top and bottom end pieces, a bunghole formed integrally in at least one of said end pieces, said bunghole comprising a cylindrical threaded vertical wall connecting a lower surface having an opening therein with an upper surface, having an opening therein, a polygonal recess formed in said per surface and a threaded polygonal insert having a threaded opening uptherein, said polygonal insert being capable of being screwed into said bunghole until said insert is locked in said recess and further capable of receiving a bung to close said opening therein.

9. The drum of claim 8, wherein a flange connects said upper surface with the surface of said end piece so that the upper surface of said bunghole is raised above the surface of the end piece, and said opening of said lower surface is substantially flush with said end piece.

10. A drum molded of cross-linked, high density polyethylene, said drum comprising:

(a) a body having a continuous substantially cylindrical wall of cross-linked polyethylene closed at its top and bottom ends, respectively, by top and bottom end pieces of cross-linked polyethylene molded and formed integrally with said continuous wall;

(b) an annular load-bearing chime of cross-linked polyethylene extending around the circumference of said cylinder and above the surface of said top end piece, said chime being integrally molded and formed with and connecting the top of said wall with said top end piece, said chime being capable of being lifted and supported by parrott-beak type drum handling equipment;

(c) at least one rolling hoop formed integrally with said continuous wall and located in the body of said drum between said annular chime and said bottom end piece, said hoop extending circumferentially around said continuous wall and capable of being engaged by the forks of a forklift regardless of the orientation of said cylinder relative to the forklift, said hoop further extending outwardly from said continuous wall a sufficient distance to support a fully loaded drum when said hoop is engaged by the forks of the forklift;

(d) a bunghole formed in said top end piece, said bunghole having a threaded opening therein and a top surface with a polygonal recess therein, said top surface of said bunghole being raised above the top surface of said end piece by a flange integrally molded with and connecting said bunghole and said top end piece, said flange being capable of absorbing expansion between said bunghole and said top surface when the pressure of the contents of said drum is increased; and (e) a threaded polygonal insert having a threaded opening therein, said polygonal insert being adapted to be screwed into said bunghole until said insert is locked in said recess, for receiving a bung to close said opening therein.

11. The drum of claim 10 further comprising a seal capable of preventing leakage placed between said insert and said bunghole.

12. The drum of claim 10 wherein said recess and said insert are hexagon shaped.

13. The drum of claim 8 further comprising a seal capable of preventing leakage placed between said insert and said bunghole.

14. The drum of claim 8 wherein said recess and said insert are hexagon shaped.

15. In a plastic drum having an integrally molded opening therein, the improvement comprising in combination a polygonal recess formed in the outer surface of said drum forming said opening and a threaded polygonal insert having inner and outer threads, said outer threads being capable of being screwed into said opening until said insert is locked in said recess and said inner threads being capable of receiving a bung to close said bunghole.

16. The drum of claim 15 further comprising a seal capable of preventing leakage placed between said insert and said bunghole.

* * * * *